US006901823B2

(12) United States Patent
Ernesti

(10) Patent No.: US 6,901,823 B2
(45) Date of Patent: Jun. 7, 2005

(54) REVERSIBLE MAGNETIC RATCHETING SPUD WRENCH

(76) Inventor: Carl J. Ernesti, 116 E. Phillip Ave., Norfork, NE (US) 68701

( * ) Notice: Subject to any disclaimer, the term of this patent is extended or adjusted under 35 U.S.C. 154(b) by 0 days.

(21) Appl. No.: 10/686,715

(22) Filed: Oct. 17, 2003

(65) Prior Publication Data

US 2005/0081685 A1 Apr. 21, 2005

(51) Int. Cl.[7] ..... B25B 13/46
(52) U.S. Cl. ..... 81/60; 7/138; 81/180.1
(58) Field of Search ..... 7/138, 157; 81/60, 81/61, 125, 180.1, 184, 462, DIG. 1

(56) References Cited

U.S. PATENT DOCUMENTS 1,155,960 A 10/1915 Ruth
1,828,142 A * 10/1931 Herdman ..... 7/138
3,156,141 A 11/1964 Pluntz
3,661,048 A 5/1972 Judd
4,237,754 A 12/1980 Battrick
5,058,327 A * 10/1991 Buchanan ..... 7/157
5,092,025 A 3/1992 Harrington
5,970,552 A * 10/1999 Kwiecien et al. ..... 7/138
6,164,166 A * 12/2000 Whiteford ..... 81/60
6,732,616 B2 * 5/2004 Lin ..... 81/180.1
2001/0032529 A1 10/2001 Barnett et al.
2003/0043574 A1 3/2003 Hsien

* cited by examiner

*Primary Examiner*—James G. Smith
(74) *Attorney, Agent, or Firm*—Richard C. Litman

(57) ABSTRACT

The reversible magnetic ratcheting spud wrench is a spud wrench having a ratcheting head in place of the typical open-ended U-shaped wrench head. The combination ratcheting spud wrench eliminates the need for a construction worker to use a separate ratchet wrench for securing bolts in the bolt holes of interconnecting steel beams after the bolt holes have been aligned by the spud wrench. The ratcheting spud wrench also includes a milled slot along the handle of the wrench having a magnetic strip disposed in the slot. The magnetic strip allows the wrench to be placed on one of the steel structural beams when it is not being used without having the wrench drop from the work place.

14 Claims, 5 Drawing Sheets

REVERSIBLE MAGNETIC RATCHETING SPUD WRENCH

BACKGROUND OF THE INVENTION

1. Field of the Invention

The present invention relates to construction spud wrenches, and more particularly to a reversible, magnetic spud wrench having a ratcheting head to eliminate the need for using separate spud and ratchet wrenches while securing interconnecting steel beams 2. Description of the Related Art Spud wrenches are typically used in construction for aligning the flange holes in interconnecting steel construction beams. The flanges holes are adapted to receive a bolt or other fastener. The spud wrench aligns the holes so that a bolt may pass through the holes on each beam to secure the beams together. Once the holes are aligned and the bolt is passed through the holes a separate ratchet wrench is then used to secure the bolt in place. This typical procedure is inefficient because it requires the construction worker to use separate wrenches to secure a single bolt in the holes of the steel beams. The procedure also creates a potentially hazardous situation because typically the spud wrench is placed on a steel beam adjacent the construction worker while he is using the ratchet wrench. When this is done, the spud wrench is easily dropped from the construction worker's work place, which is often high above other co-workers.

The following patent documents disclose examples of existing spud wrenches and ratchet wrenches.

U.S. Patent Application No. 2001/0032529 published on Oct. 25, 2001 for Barnett et al. discloses a positive locking system for socket ratchet wrenches. The sockets have at least one circumferential axially aligned annular groove extending about the exterior surface with one or more openings in the side of the grooves for receiving sections on the ratchet wrench that cooperate with the socket grooves to positively lock the socket to the wrench.

U.S. Patent Application No. 2003/0043574 published on Mar. 6, 2003 for Hsien discloses a ratchet wrench and lighting circuit. The ratchet wrench has a hollow driving member mounted in a box at one end, a holder shell fitted into the ratchet driving member and detachably secured to it by a screw joint and a lighting circuit assembly installed in the holder shell. The lighting circuit is controlled to emit light through a lens on the bottom of the ratchet driving member.

U.S. Pat. No. 1,155,960 issued on Oct. 5, 1915 to Ruth discloses a ratchet compound spud wrench. The wrench provides a plurality of spuds or nipple engaging sections that vary in size. The spuds are provided on their oppositely disposed lugs. The central portion of the wrench has an integral disc having a plurality of ratchet teeth. The spud engaging sections extend through a hole in the center of the integral disc.

U.S. Pat. No. 3,156,141 issued on Nov. 10, 1964 to Pluntz discloses a combination inside-outside spud wrench. The invention provides a spud wrench for assembling and dissembling spud assemblies in water inlets for commodes in which the spud assembly includes an externally threaded nipple to receive a locking nut, and has a flange at its end engaging the walls of the commode inlet. The nipples include a series of inwardly extending spaced lugs in its bore.

U.S. Pat. No. 3,661,048 issued on May 9, 1972 to Judd discloses a fastening means for structural members. The fastening means includes an unthreaded bolt having a partially tapered shank, a noncircular head and at least one hole through the shank and a generally rod shaped locking pin that is capable of fitting in the hole of a shank of a bolt. The locking pin has an eye portion at one end adapted to receive a tool to facilitate removal of the locking pin from the bolt and an expanded portion in the locking pin limiting the portion of the locking pin passing through the hole in the bolt.

U.S. Pat. No. 4,237,754 issued on Dec. 9, 1980 to Battrick discloses a universal spud wrench. The universal spud wrench is designed for rapid installation and removal of all types of spuds from drains. The wrench includes a tubular shaft having four perpendicularly oriented slope surfaces forming slots and aligned extensions next to the slots that are defined by varying diameters about a central axis.

U.S. Pat. No. 5,092,025 issued to Harrington on Mar. 3, 1992 discloses a closet spud tool. The device is a four way closet spud insertion tool for inserting a spud into an inlet/outlet hole of a plumbing fixture. The closet spud includes a couple having at least one lug protruding inwardly therefrom and a gasket surrounding the couple, the gasket having a flared portion that is to be inserted into the inlet/outlet hole of the fixture with a portion of the couple, the diameter of the flared portion being greater than the diameter of the whole. The tool comprises a cross-shaped body having four arms extending from a center point thereof, each of the arms terminating in a different head, each of the heads is configured to be insertable into a respectively sized couple.

U.S. Pat. No. 6,164,166 issued on Dec. 26, 2000 to Whiteford discloses a low-profile ratchet wrench having magnetically retained thin-walled sockets. The socket wrench system includes a set of thin-walled sockets, each having a round peripheral surface around which a multiplicity of gear like teeth are distributed and a ratchet wrench having a cylindrical opening in its head in which a socket is releasably maintained. Permanent magnets supported in the wrench head maintain the socket in easily releasable engagement with the wrench.

None of the above inventions and patents, taken either singly or in combination, is seen to describe the instant invention as claimed. Thus a reversible magnetic ratcheting spud wrench solving the aforementioned problems is desired.

SUMMARY OF THE INVENTION

The reversible magnetic ratcheting spud wrench combines a ratchet wrench with a construction spud wrench. The wrench has an elongate main body with a bolt securing end and a flange hole alignment end. The flange hole alignment end provides an oval shaped tip that conforms to the oval shaped flange holes disposed on typical steel beams. The oval shaped tip is adapted for fitting into and aligning the bolt receiving flange holes on interconnecting steel structural beams. The bolt securing end of the wrench provides a ratchet head for securing the interconnecting steel structural beams. Once the beams are aligned a bolt is passed through the aligned holes of the two steel beams. The ratchet head on the wrench secures the bolt in place by tightening a nut onto the bolt. The wrench further provides a milled slot in a portion of the main body of the wrench. A magnetic strip for preventing the wrench from falling from an elevated workplace is disposed inside of the slot.

Accordingly, it is a principal object of the invention to provide a spud wrench having a ratcheting head for allowing a construction worker to use a single wrench to align the bolt receiving holes of interconnecting steel beams and to secure a bolt inside of the aligned holes.

It is another object of the invention to provide a ratcheting spud wrench having a magnetic strip embedded in the main body of the wrench to prevent the wrench from falling from an elevated work station.

It is a further object of the invention to provide a ratcheting spud wrench having a wrench stop collar for preventing the gripping portion of the ratchet head from slipping past the fastener being tightened by the wrench.

Still another object of the invention is to provide a ratchet head that is magnetized to improve the grip of the ratchet wrench around the fastener being tightened.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
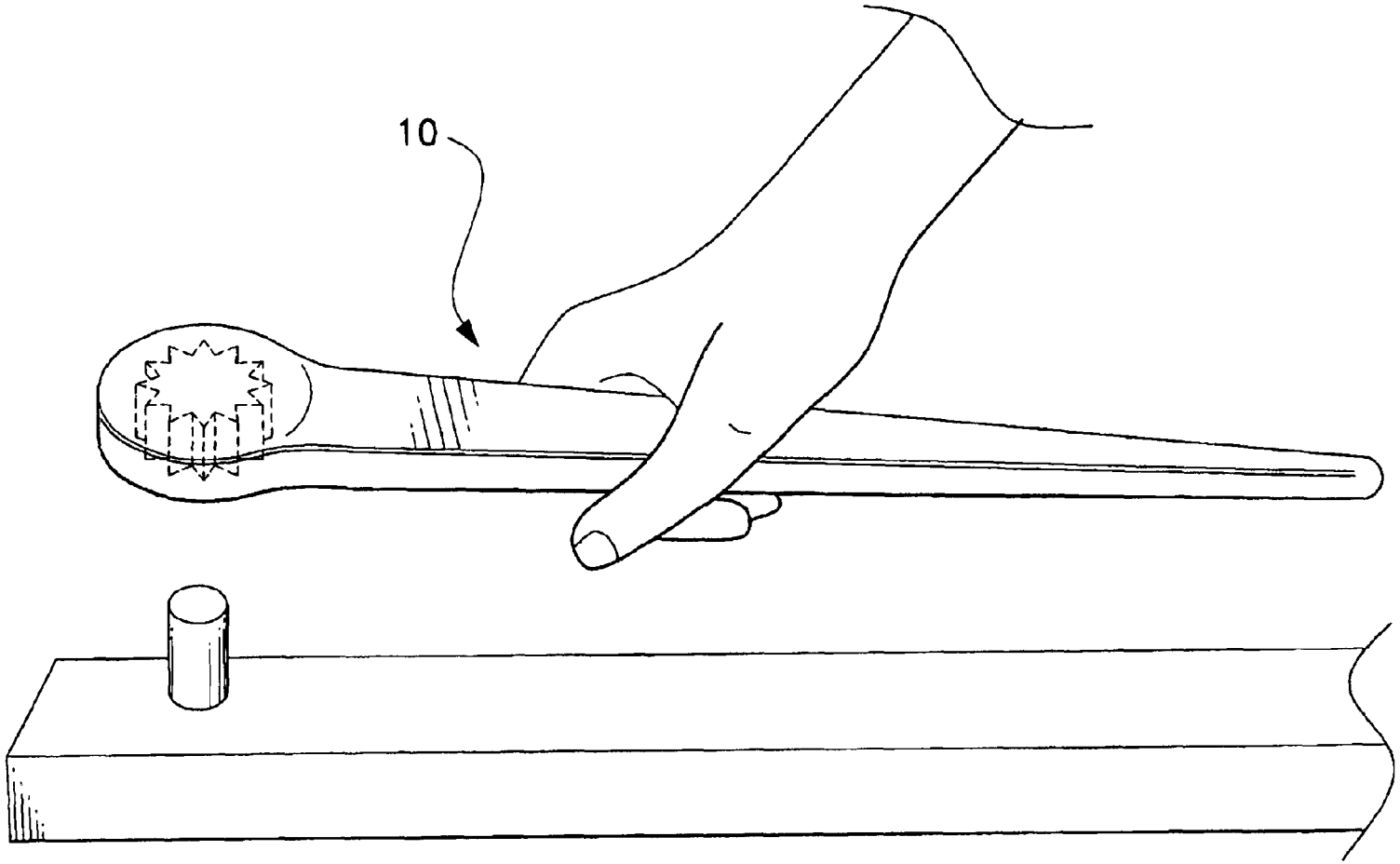
FIG. 1 is an environmental, perspective view of a reversible magnetic ratcheting spud wrench according to the present invention.

The present invention is a combination spud wrench and ratchet wrench. FIG. 1 is an environmental, perspective view of a ratcheting spud wrench 10 according to the present invention. The ratcheting spud wrench 10 allows a steel construction worker to use a single wrench to align the bolt receiving flange holes disposed on interconnecting steel structural beams and tighten a bolt that is positioned inside of the aligned flange holes. Typically, a spud wrench is used to align the flange holes of the interconnecting steel beams. Once aligned, a bolt is extended through the flange holes. The bolt is then secured in place by tightening a bolt fastener, or nut onto the bolt with a separate ratchet wrench. The present invention allows a construction worker to use a single wrench for the entire process.

Figure 2:
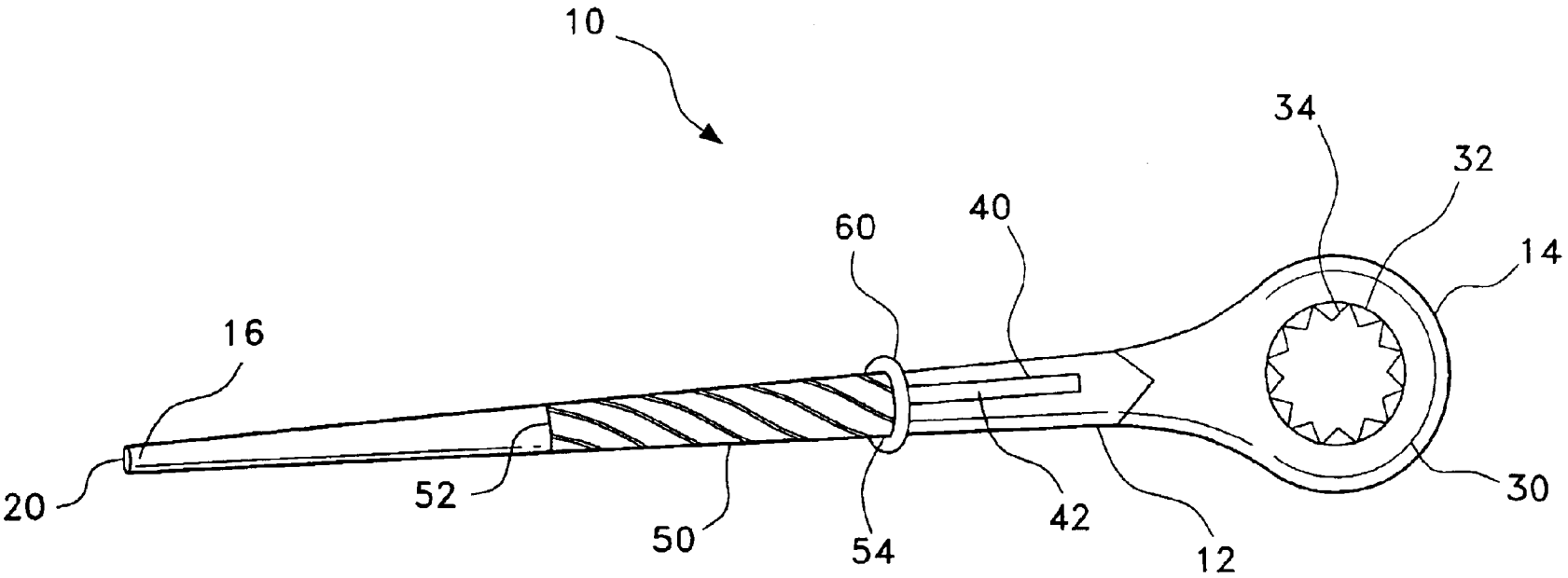
FIG. 2 is a bottom view of the reversible magnetic ratcheting spud wrench.

FIG. 2 is a bottom view of the ratcheting spud wrench 10 of the present invention. The ratcheting spud wrench 10 comprises a shaft 12 having an elongate body with a hole aligning end 16 and a fastener gripping end 14. The shaft 12 has a width that is greater at the fastener gripping end 14 than at the hole aligning end 16. The width of the shaft 12 continuously increases along the length of the shaft 12 from the hole aligning end 16 to the fastener gripping end 14.

A flange hole aligning portion is disposed on the shaft 12 at the hole aligning end 16 of the wrench 10. The hole aligning portion comprises a flat, generally oval shaped alignment tip 20. The alignment tip 20 is oval shaped to conform to the oval shaped flange holes of typical steel beams. The alignment tip 20 is adapted to be inserted into the flange holes of interconnecting steel beams. Because the alignment tip 20 is generally oval shaped, as are the flange holes on a typical steel beam, the ratcheting spud wrench 10 accurately aligns the flange holes of the interconnecting beams.

A ratchet head 30 is disposed on the shaft 12 at the fastener gripping end 14 of the spud wrench 10. The ratchet head 30 comprises a center through hole 32 for receiving a nut or other bolt fastener. A gripping portion 34 is disposed along the periphery of the center through hole 32. In the present embodiment depicted in FIG. 2, the gripping portion comprises a plurality of gripping teeth. Once the flange holes of interconnecting steel beams are aligned by the alignment tip 20, a bolt is extended through the aligned holes. The ratchet head 30 of the ratcheting spud wrench 10 is then used to tighten a nut onto the bolt to secure the interconnected steel beams to one another. The nut is tightened onto the bolt by turning the shaft 12 of the wrench 10, which applies a torque to the nut and tightens it against the bolt.

Figure 3:
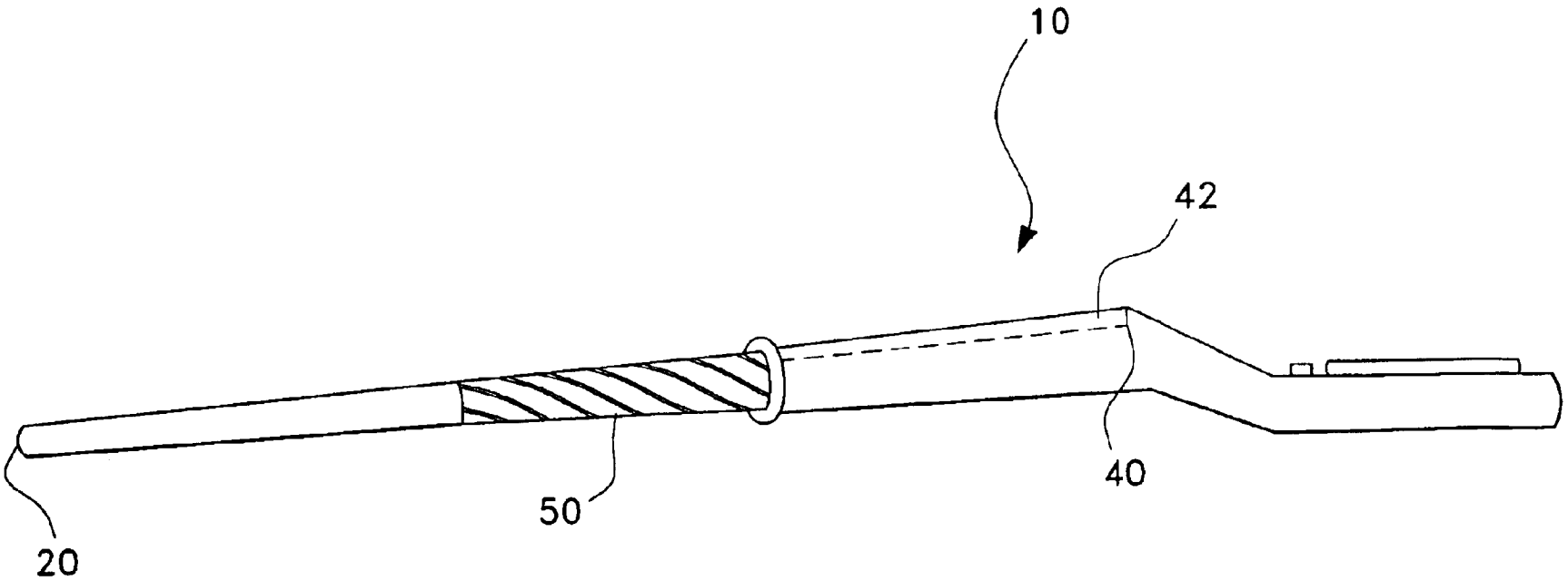
FIG. 3 is a side view of the reversible magnetic ratcheting spud wrench.

According to certain preferred embodiments of the present invention the ratcheting spud wrench 10 further comprises an elongate milled slot 40 extending along a bottom surface of the shaft 12. FIG. 3 shows the depth of the slot 40 into the surface of the shaft 12. A magnetic strip 42 is embedded in the milled slot 40. The magnetic strip 42 is embedded in the slot 40 so that the top surface of the magnetic strip 42 is flush with the surface of the shaft 12. Structural steel construction workers often work in elevated workspaces. In some situations the worker will place his wrench on one of the steel beams while he is not using the wrench. This creates a hazardous situation because the wrench could fall from the elevated workspace and injure a coworker. The magnetic strip 42 disposed along the shaft 12 of the spud wrench 10 secures the spud wrench 10 to the steel beam that it is placed on, preventing it from falling from an elevated workspace.

According to certain preferred embodiments of the present invention the spud wrench 10 further comprises a reaming member 50 disposed along the shaft 12 of the spud wrench 10. The reaming member comprises a plurality of spiral or straight fluted cutting edges for finishing a hole to size and shape. The reaming member 50 has a bottom edge 52 and a top edge 54. When the spud wrench 10 is inserted into a hole the bottom edge 52 of the reaming member 50 enters into the hole. Once the reaming member 50 is fully inserted into a hole the spud wrench 10 may be rotated to cause the reaming member 50 to size and shape the hole. A hole sizing collar 60 is slidably disposed along the shaft 12 of the wrench 10. The hole sizing collar 60 is positioned along the shaft 12 to prevent the reaming member 50 from entering into the hole beyond a predetermined point. The hole sizing collar 60 limits the portion of the hole that is being reamed.

According to certain preferred embodiments of the present invention the gripping portion 34 of the ratcheting head 30 is magnetized to improve the grip of the wrench 10 on the nut being tightened.

Figure 4:
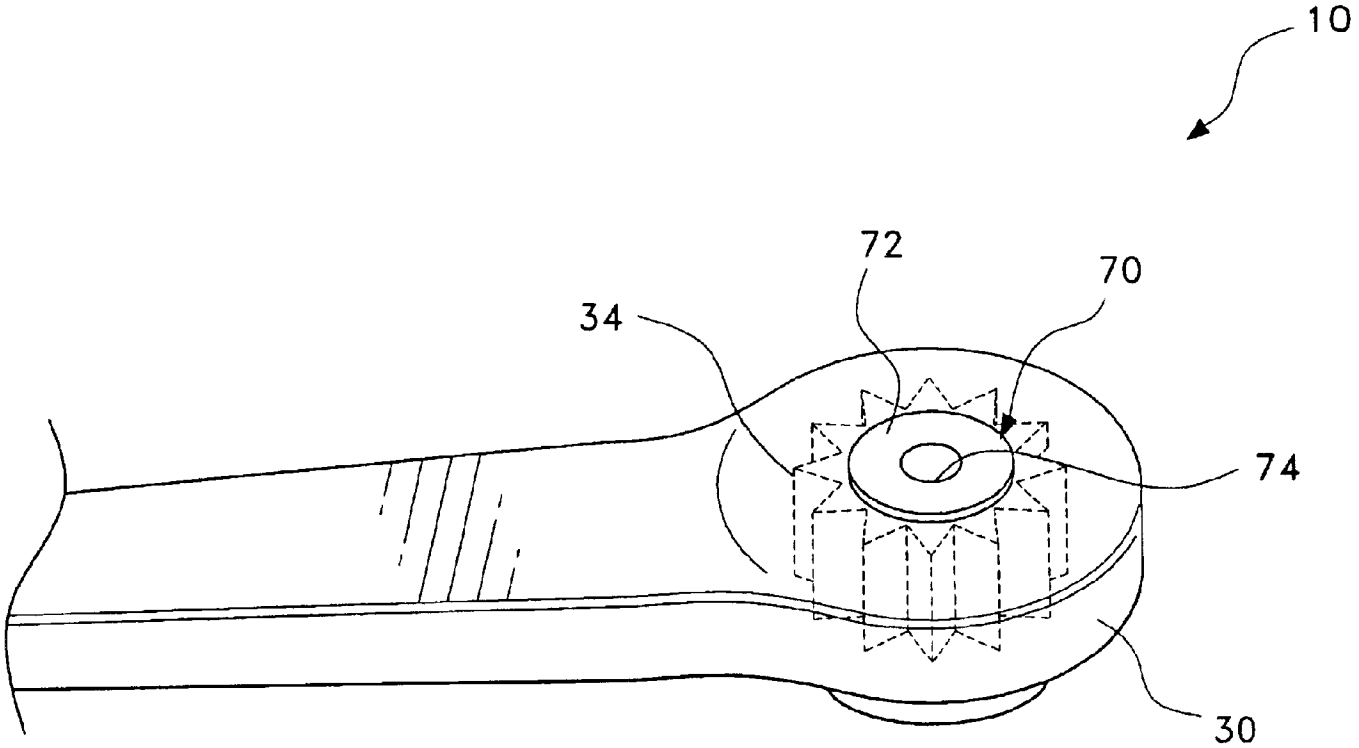
FIG. 4 is a top perspective view of the reversible magnetic ratcheting spud wrench according to an alternate preferred embodiment.

According to certain preferred embodiments of the present invention the ratcheting spud wrench 10 further comprises a wrench stop collar 70 (shown in FIG. 4) disposed on a top surface of the spud wrench 10. The wrench stop collar 70 is positioned above the center through hole 32 of the ratchet head 30. The wrench stop collar 70 comprises a generally flat, circular plate 72 having a center hole 74. The size of the center hole 74 is slightly larger than the outer diameter of the bolt being secured by the spud wrench 10. The center hole 74 of the wrench stop collar 70 allows the bolt to pass through but is small enough to prevent the nut that is being tightened to pass through. This prevents the spud wrench 10 from sliding down past the nut and losing its grip on the nut as it is being tightened. The wrench stop collar 70 may be fixedly secured to the spud wrench 10, by welding or by a chemical adhesive, or it may be releasably attached to the spud wrench 10 so that it may be removed in certain situations.

Figure 5A:
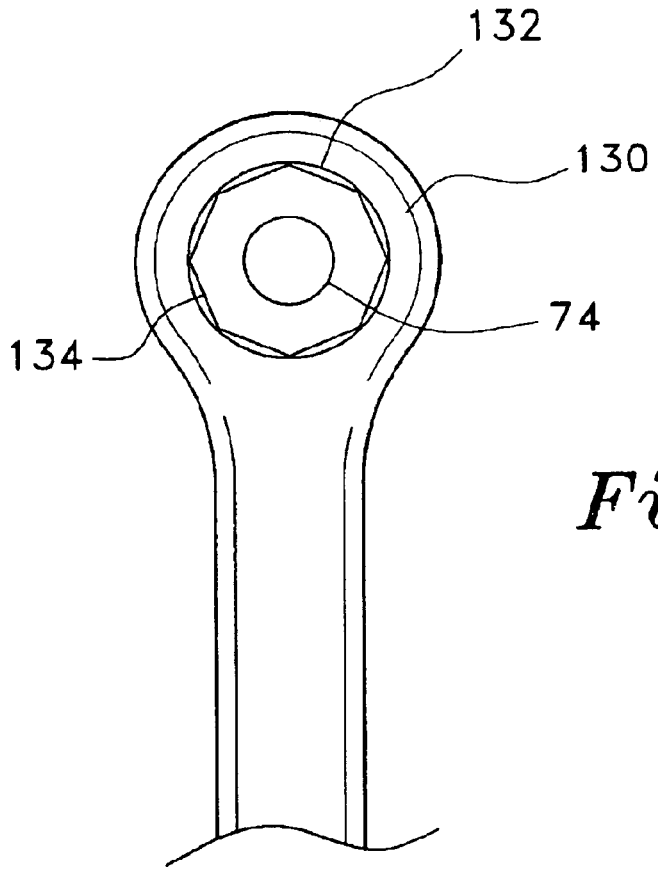
FIGS. 5A and 5B are bottom views of additional embodiments of the reversible magnetic ratcheting spud wrench.
Figure 5B:
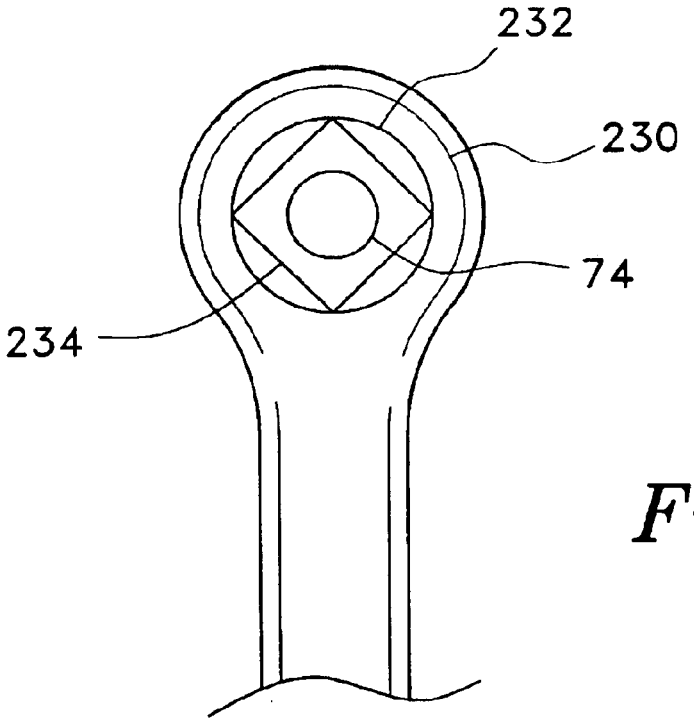

FIGS. 5A and 5B are bottom views of the ratchet heads of two additional embodiments of the present invention. FIG. 5A depicts a ratchet head 130 according to a certain preferred embodiment of the present invention. The ratchet head 130 provides a center through hole 132 having a gripping portion 134 disposed around its periphery. The gripping portion 134 according to the present embodiment comprises an eight sided, generally octagonal gripping surface.

FIG. 5B depicts a ratchet head 230 according to a certain preferred embodiment of the present invention. The ratchet head 230 provides a center through hole 232 having a gripping portion 234 disposed around its periphery. The gripping portion 234 according to the present embodiment comprises a four sided, generally square shaped gripping surface.

The center through hole 32 and the gripping portion 34 of the ratchet head 30 may be designed in any typical size and are not limited to the common sized ratchet heads used in the steel industry.

It is to be understood that the present invention is not limited to the embodiments described above, but encompasses any and all embodiments within the scope of the following claims.

I claim:

1. A ratcheting spud wrench, comprising:

a shaft having an elongate main body with a fastener gripping end, a hole aligning end, a top surface and a bottom surface;

an elongate, milled slot extending alone said bottom surface of said main body;

a magnetic strip disposed inside of said milled slot;

a generally flat oval aligning portion disposed on said hole aligning end adapted for passing through bolt receiving flange holes of interconnecting steel structural beams for aligning the flange holes of the interconnecting beams so that a single bolt may pass through the flange holes of the interconnecting beams; and a ratchet head disposed on said fastener gripping end having a center through hole for receiving a bolt and a bolt fastener, and a gripping portion disposed around the periphery of said center through hole for gripping the bolt fastener;

whereby said shaft is turnable to apply torque to the bolt fastener to tighten or loosen the bolt positioned inside of the aligned holes of the steel beams so that a separate ratcheting wrench is not necessary when aligning and securing interconnecting steel beams.

2. The ratcheting spud wrench according to claim 1, wherein the width of said main body is larger at said fastener engaging end than at said hole aligning end so that as you move along said main body from said fastener engaging end to said hole aligning end the width of said main body continuously increases.

3. The ratcheting spud wrench according to claim 1, wherein said ratchet head is magnetized to improve gripping of fasteners.

4. The ratcheting spud wrench according to claim 1, wherein said gripping portion comprises a plurality of gripping teeth.

5. The ratcheting spud wrench according to claim 1, wherein said gripping portion comprises a four sided square gripping portion.

6. The ratcheting head according to claim 1, wherein said gripping portion comprises an eight sided octagonal gripping portion.

7. The ratcheting head according to claim 1, further comprising a wrench stop collar for preventing the ratchet head from slipping off of the fastener held by said gripping portion.

8. The ratcheting spud wrench according to claim 7, wherein said wrench stop collar comprises a circular plate having a center through hole disposed on a top surface of said ratchet head.

9. The ratcheting spud wrench according to claim 7, wherein said collar is fixedly secured to said ratchet head.

10. The ratcheting spud wrench according to claim 7, wherein said collar is removably secured to said ratchet head.

11. The ratcheting spud wrench according to claim 9, wherein said collar is welded onto said ratchet head.

12. The ratcheting spud wrench according to claim 9, wherein said collar is secured to said ratchet head by a chemical adhesive.

13. A ratcheting spud wrench comprising:

a shaft having an elongate main body with a fastener gripping end, a hole aligning end, a top surface and a bottom surface;

a generally flat oval aligning portion disposed on said hole aligning end adapted for passing through bolt receiving flange holes of interconnecting steel structural beams for aligning the flange holes of the interconnecting beams so that a single bolt may pass through the flange holes of the interconnecting beams;

a ratchet head disposed on said fastener gripping end having a center through hole for receiving a bolt and a bolt fastener, and a gripping portion disposed around the periphery of said center through hole for gripping the bolt fastener; and a reaming portion having a plurality of cutting edges for reaming holes;

whereby said shaft is turnable to apply torque to the bolt fastener to tighten or loosen the bolt positioned inside of the aligned holes of the steel beams so that a separate ratcheting wrench is not necessary when aligning and securing interconnecting steel beams.

14. The ratcheting spud wrench according to claim 13, further comprising a hole sizing collar slidably disposed along said main body to prevent said reaming portion from reaming a hole beyond a specific point.

* * * * *